United States Patent [19]

Pomares

[11] 4,286,893

[45] Sep. 1, 1981

[54] HANDLE ATTACHING MEANS FOR RAKES AND THE LIKE

[76] Inventor: Francis Pomares, 124 Russell St., White Plains, N.Y. 10606

[21] Appl. No.: 148,767

[22] Filed: May 12, 1980

[51] Int. Cl.[3] ..... B25G 3/00

[52] U.S. Cl. ..... 403/301; 16/114 R; 172/371

[58] Field of Search ..... 403/301, 302, 313, 199, 403/198; 56/400.01, 400.04, 400.16, 400.19, 400.21; 172/371, 380; 16/114 R

[56] References Cited

U.S. PATENT DOCUMENTS

| | | | |
|---|---|---|---|
| 271,471 | 1/1883 | Johnston | 16/111 A UX |
| 1,754,415 | 4/1930 | Connors | 403/246 |
| 1,828,250 | 10/1931 | Hawkes | 403/287 |
| 1,940,129 | 12/1933 | Howe et al. | 16/111 A UX |
| 2,502,368 | 3/1950 | Carlson | 403/259 |
| 2,540,590 | 2/1951 | Mead et al. | 403/180 |
| 2,794,689 | 6/1957 | Rubrum | 403/301 |
| 2,798,749 | 7/1957 | Herman et al. | 403/313 X |

FOREIGN PATENT DOCUMENTS

| | | | |
|---|---|---|---|
| 123984 | 3/1928 | Switzerland | 403/199 |
| 192871 | 2/1923 | United Kingdom | 403/199 |

*Primary Examiner*—Andrew V. Kundrat
*Attorney, Agent, or Firm*—Eugene E. Geoffrey, Jr.

[57] ABSTRACT

A handle attachment for implements such as rakes and hoes which includes a cylindrical portion adapted to be clamped tightly about the end of the handle and a tapered extension extending from one end of the cylindrical portion and away from the handle for attachment to the implement.

1 Claim, 4 Drawing Figures

HANDLE ATTACHING MEANS FOR RAKES AND THE LIKE

This invention relates to handle attaching means for implements such as rakes, hoes and the like and more specifically to a novel and improved device removably secured to an implement and arranged to removably retain a handle so that both the implement and the handle can be quickly and easily removed for repair or replacement.

Numerous structures have been suggested for attaching handles to implements of various types but in most instances the handles are permanently secured to the implements and generally require a special end configuration to enable the attachment to be effected. In the case of rakes, hoes and the like, should either the implement or the handle break or be deformed, it is necessary to procure a new implement with the handle attached.

This invention overcomes the foregoing difficulties and provides a novel and improved handle attaching means for implements which is characterized by its simplicity, low cost and east of attachment to both the implement and handle.

Another object of the invention resides in the provision of novel and improved means for attaching a handle to an implement which facilitates ready replacement of either the implement or handle.

The attaching means in accordance with the invention comprises a bracket having a split cylindrical portion adapted to receive one end of a handle. The longitudinal edges of the split cylindrical portion have means such as ears or flanges extending therefrom which are provided with bolt receiving holes to enable the cylindrical portion to be clamped tightly about the handle. The cylindrical portion is further provided with a tapered extension extending from one end thereof and in a direction away from said handle which includes means for fixedly attaching it to an implement such as a rake or hoe. In this way, the handle and implement can be readily replaced should one or the other become damaged or broken.

The above and other objects and advantages of the invention will become more apparent from the following description and accompanying drawings forming part of this application.

IN THE DRAWINGS

Figure 1:
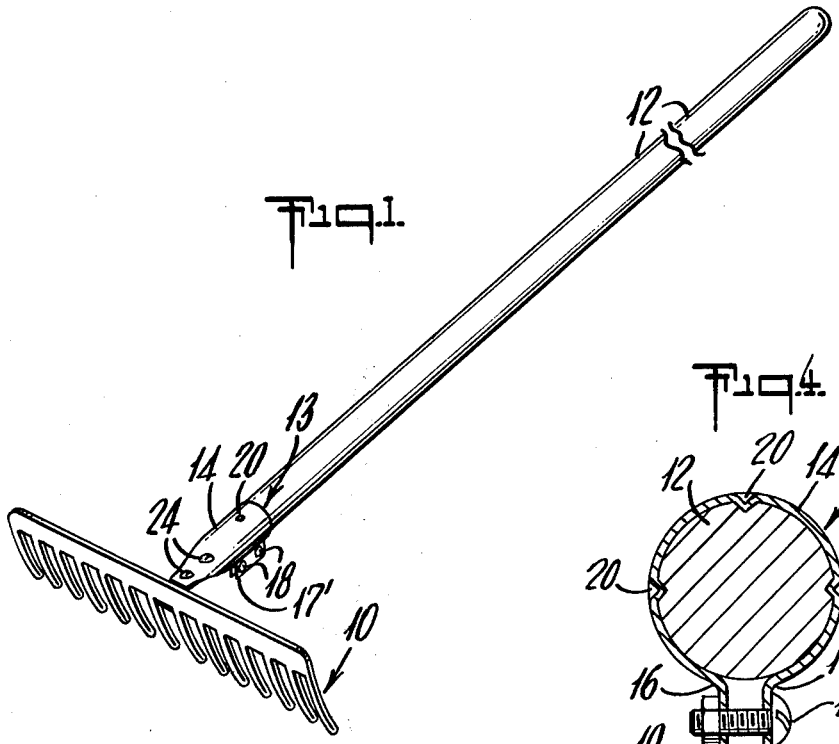
FIG. 1 is a perspective view of a garden rake showing novel and improved means for affixing a handle to the rake head in accordance with the invention.
Figure 4:
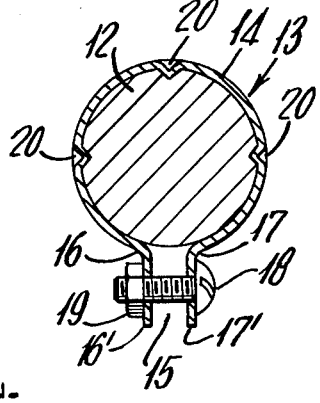
FIG. 4 is a cross sectional view of FIG. 2 taken along the line 4—4 thereof.
Figure 2:
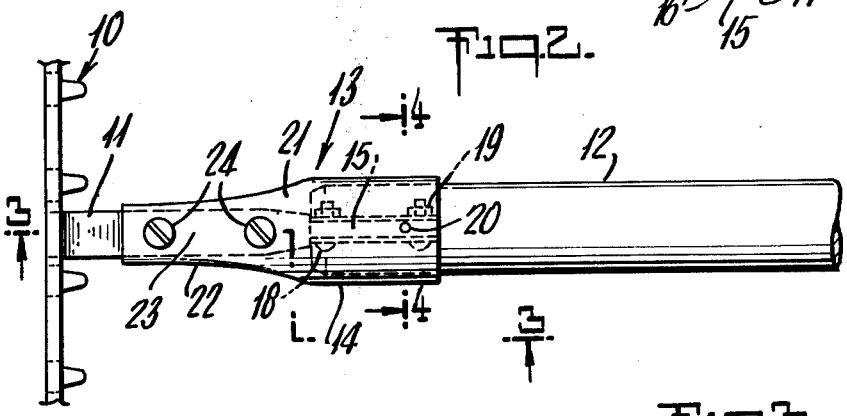
FIG. 2 is a top plan view of a fragmentary portion of the structure shown in FIG. 1 and illustrating the handle attaching means in accordance with the invention.
Figure 3:
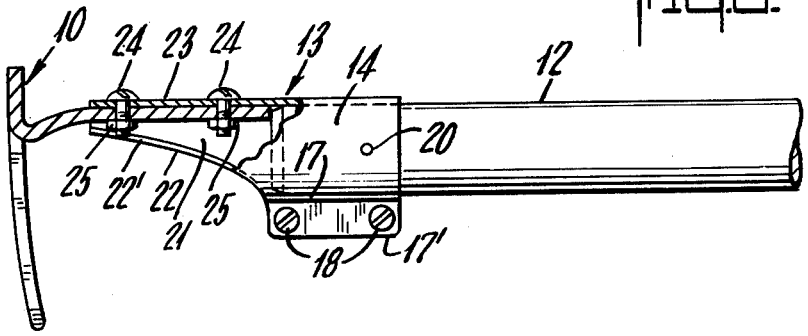
FIG. 3 is a side elevational view of the structure shown in FIG. 2.

Referring now to the drawings, a rake head is denoted by the numeral 10 and has a rearwardly extending tongue or bracket 11 secured generally centrally of the rake head 10. The handle 12 is secured to the rearwardly extending tongue or bracket 11 by means of novel and improved handle attaching means generally denoted by the numeral 13. The handle attaching means 13 is preferably of unitary construction and includes a cylindrical portion 14 having a longitudinally disposed slit 15 forming a pair of longitudinally disposed edges 16 and 17 spaced one from the other. The edges 16 and 17 have outwardly extending flanges 16' and 17' which have openings for receiving a pair of bolts 18 and cooperating nuts 19. A plurality of inwardly extending protrusions 20 are formed in the surface of the cylindrical portion 14 and function to forceably engage the handle 12 when positioned within the cylindrical portion 14 and the bolts 18 with cooperating nuts 19 are tightened to draw the flanges 16' and 17' one toward the other to clamp the cylindrical portion 14 about the end of the handle. With this arrangement, the end of the handle 12 need not have any specific configuration but need only be cylindrical and of a diameter which will facilitate engagement with the cylindrical portion 14. By reason of the relatively wide gap between the flanges 16' and 17', the diameter of the handle 12 is not critical and therefore the attaching means can accommodate a wide variety of handle sizes. The forward portion 21 of the handle attaching means is preferably formed integrally with the cylindrical portion 14 and has an arcuate configuration which may have a radius similar to the radius of the cylindrical portion 14. The angular width of the forward portion 21 gradually decreases toward the forward end as indicated by the curved edge portions 22. The edge portions 22 are also preferably rolled to form edge beads 22' to provide for additional rigidity. If desired, the base portion 23 of the forwardly extending portion 21 may be flattened to accommodate the tongue 11 extending from the central portion of the rake head 10. The tongue 11 is secured to the forwardly extending portion 21 of the attaching means by a pair of bolts 24 and cooperating nuts 25.

With this arrangement, it is evident that the novel and improved attaching means 13 not only facilitates replacement of the handle 12 should it be broken or otherwise damaged but also enables a new rake head 10 to be affixed to the handle without the necessity for replacing the entire structure should the rake head break. Moreover, since the handle and attaching means 13 can be readily disengaged from the rake head 10, packaging for shipment is greatly facilitated since a larger number of implements can be packed within a relatively small space thus reducing both packaging and shipping costs. Furthermore, since the rake heads 10 are normally provided with a rearwardly extending tongue 11 the attaching means in accordance with the invention can be readily accommodated to existing rake heads by merely drilling a pair of holes in the tongue in alignment with the holes in the attaching means. Thus, should a handle break or become disengaged from a conventional rake head 10, the existing handle can be readily attached to the rake by the utilization of the attaching means in accordance with the invention. In such cases, it is merely necessary to remove the tapered end portion on the handle normally utilized in the attachment of the handles to rakes and then engage the cut end of the handle with the cylindrical portion 14 of the attaching means.

While only one embodiment of the invention has been illustrated and described, it is apparent that alterations, changes and modifications may be made without departing from the true scope and spirit thereof.

What is claimed is:

1. Means for attaching an elongated handle to an implement such as a rake or hoe having a narrow elongated metal member extending therefrom, said attaching means comprising a longitudinally slotted cylindrical portion having inwardly extending protrusions for receiving an end of said elongated handle, the edges of said member adjoining said slot having cooperating outwardly extending substantially parallel flanges, means engaging said flanges to move them one toward the other to clamp said cylindrical member tightly about said handle, said attaching means further including a forwardly extending generally arcuate portion having a radius corresponding to the radius of said cylindrical portion and an arcuate width approximately equal to the circumferential length of said cylindrical portion and integrally formed with said cylindrical portion, said forwardly extending portion gradually decreasing in arcuate width forming a tapered portion and terminating in a substantially U-shaped portion having an internal width approximately equal to the width of said narrow elongated member, said U-shaped portion having a flattened portion joining the legs of said U-shaped portion and extending rearwardly to a point spaced from said cylindrical portion, reinforcing beads formed on the legs of said U-shaped portion and extending one toward the other, said flattened portion and said narrow elongated member having cooperating openings, and fastening means engaging said openings to secure the narrow elongated member to said forwardly extending portion of said attaching means.

* * * * *